US009370233B2

(12) United States Patent
Jung

(10) Patent No.: US 9,370,233 B2
(45) Date of Patent: Jun. 21, 2016

(54) PUMP-TYPE AMPOULE CONTAINER CAPABLE OF BEING REFILLED

(75) Inventor: Seo-Hui Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 14/351,316

(22) PCT Filed: Dec. 16, 2011

(86) PCT No.: PCT/KR2011/009742

§ 371 (c)(1),
(2), (4) Date: Apr. 11, 2014

(87) PCT Pub. No.: WO2013/054982

PCT Pub. Date: Apr. 18, 2013

(65) Prior Publication Data

US 2014/0286689 A1 Sep. 25, 2014

(30) Foreign Application Priority Data

Oct. 12, 2011 (KR) ..... 10-2011-0103979

(51) Int. Cl.

| | |
|---|---|
| ***A45D 34/04*** | (2006.01) |
| ***B05B 11/00*** | (2006.01) |
| *A45D 34/00* | (2006.01) |

(52) U.S. Cl.

CPC ..... *A45D 34/041* (2013.01); *B05B 11/0054* (2013.01); *B05B 11/3004* (2013.01); *B05B 11/3015* (2013.01); *B05B 11/3026* (2013.01); *B05B 11/3047* (2013.01); *A45D 2034/005* (2013.01); *A45D 2200/054* (2013.01); *B05B 11/0037* (2013.01); *B05B 11/3023* (2013.01); *B05B 11/3052* (2013.01)

(58) Field of Classification Search

USPC ..... 401/216, 219

See application file for complete search history.

(56) References Cited

U.S. PATENT DOCUMENTS

| | | | | |
|---|---|---|---|---|
| 6,406,207 | B1 * | 6/2002 | Wiegner et al. | 401/272 |
| 6,488,431 | B1 * | 12/2002 | Bocola | 401/216 |
| 6,533,482 | B1 * | 3/2003 | Byun | 401/180 |

FOREIGN PATENT DOCUMENTS

| | | |
|---|---|---|
| JP | 2003-265228 | 9/2003 |
| KR | 2002827640000 | 1/2003 |
| KR | 10200600113336 | 11/2006 |
| KR | 1007819750000 | 12/2007 |

* cited by examiner

*Primary Examiner* — David Walczak

(74) *Attorney, Agent, or Firm* — Marshall, Gerstein & Borun LLP

(57) ABSTRACT

The pump-type container capable of being refilled is a dual container comprising an inner container and an outer container, wherein a discharge portion is fixed to the upper portion of the outer container and the inner container accommodating the contents can be replaced. Therefore, it is possible to replace only the inner container while using the same discharge portion when the contents are exhausted, thereby reducing costs for a user.

2 Claims, 7 Drawing Sheets

PUMP-TYPE AMPOULE CONTAINER CAPABLE OF BEING REFILLED

BACKGROUND

The present invention relates to a pump-type ampoule container capable of being refilled, and in particular to a pump-type ampoule container capable of being refilled, wherein a container is constituted in a dual container structure that comprises an inner container and an outer container. A discharge part is fixed to top of the outer container, and the inner container that contains contents can be replaced. When the contents are all used, only the inner container is removed and replaced while leaving the discharge part, so a user can save costs.

An ampoule container is generally configured to store contents that need to be sealed in a sterilized state. In recent years, as people tend to have a big attention in beauty, a program-like cosmetic is developed and sells, with which a user can be cared for four or eight weeks to improve wrinkles and whitening effects. The use of an ampoule container increases because it needs to store an expensive cosmetic made from a concentrated component such as essence, etc.

Compared with other cosmetics, the cosmetic contained in the above mentioned ampoule container has a shorter distribution period after it is once opened. Since the components of the contents are different in each makeup stage, the above mentioned cosmetic is made in a set of small packages each containing a small amount of cosmetic. For the above mentioned cosmetic, a discharge part equipped with an applicator such as ball, silicon tip, brush, etc. is provided on top of a container body so as to help a user's face absorb in an effective way because the cosmetic is expensive.

In the conventional ampoule container, a discharge part equipped with an applicator to discharge contents is provided on top of each ampoule container that is provided in multiple numbers and has a small volume. When it needs to discard an ampoule container after the cosmetic is all used, the discharge part provided on top of each ampoule container is discharged together, so a user should pay more costs for the products.

SUMMARY OF THE INVENTION

Accordingly, the present invention is made so as to improve the above mentioned problems. It is an object of the present invention to provide a pump-type ampoule container capable of being refilled, wherein a container is constituted in a dual container structure that comprises an inner container and an outer container. A discharge part is fixed to top of the outer container, and the inner container that contains contents can be replaced. When the contents are all used, only the inner container is removed and replaced while leaving the discharge part, so a user can save costs.

To achieve the above object, there is a pump-type ampoule container capable of being refilled, comprising an inner container that contains contents; a pumping member that is secured to top of the inner container and discharges the contents contained in the inner container on the basis of a pumping operation; an outer container that is configured to accommodate the inner container and the pumping member and includes an open bottom for the inner container and the pumping member to be inserted or to be disengaged via the open bottom, wherein both lower sides of the outer container are partly cut-away for a user to grasp the inner container for its exchange; a discharge part that is secured to top of the outer container and is in communication with the pumping member and is configured to discharge outside the contents on the basis of a pumping operation of the pumping member as the inner container ascends or descends; and an over cap that is secured covering the discharge part from top of the outer container.

In addition, a communication part is provided in an inner side of top of the outer container and extends from an inner circumferential surface of the outer container to its center portion and includes a space through which contents move, the communication part allowing the pumping member and the discharge part to communicate as the top of the pumping member and the bottom of the discharge part are engaged.

In addition, the discharge part comprises an applicator with which to apply contents on a user's skin; a support part that accommodates the applicator and supports the applicator; and an engaging part that extends in a downward direction of the support part and includes a hollow shape through which move the contents and that is secured to the communication part.

In addition, the support part comprises a support protrusion that supports the bottom of the applicator.

In addition, the inner container comprises a shoulder that covers an outer circumferential surface of the bottom of the inner container.

In the present invention, a container is constituted in a dual container structure that comprises an inner container and an outer container. A discharge part is fixed to top of the outer container, and the inner container that contains contents can be replaced. When the contents are all used, only the inner container is removed and replaced while leaving the discharge part, so a user can save costs.

DETAILED DESCRIPTION OF THE INVENTION

Figure 1:
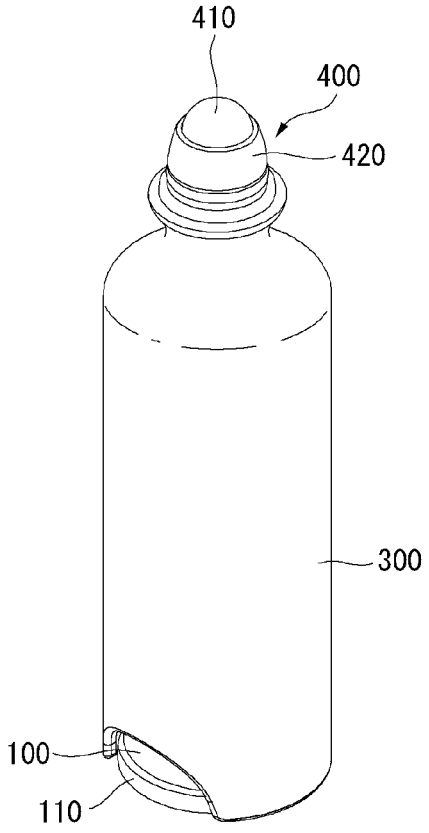
FIG. 1 is an engaged perspective view illustrating a construction of a pump-type ampoule container capable of being refilled according to a preferred embodiment of the present invention.

The preferred embodiment of the present invention will be described. It is noted that the same reference numerals represent the same components.

Figure 2:
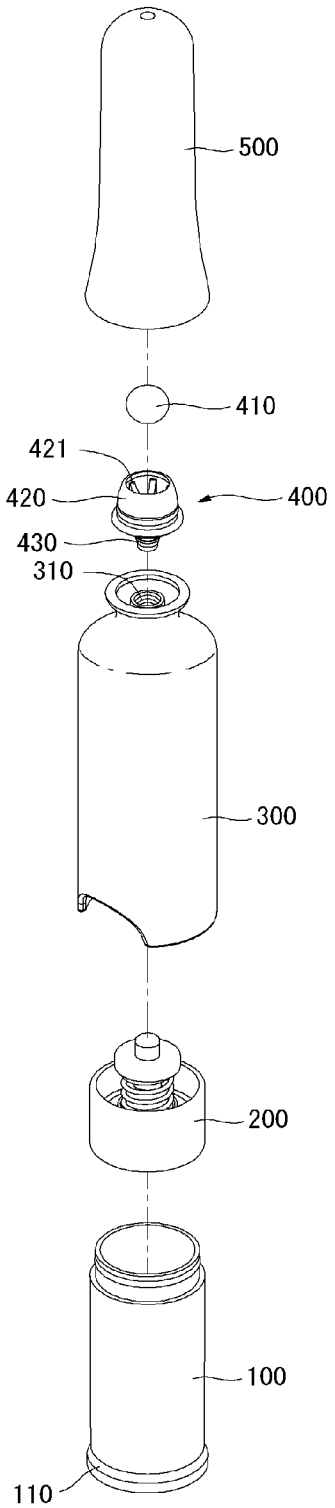
FIG. 2 is a disassembled perspective view illustrating a construction of a pump-type ampoule container capable of being refilled according to a preferred embodiment of the present invention.

FIG. 1 is an engaged perspective view illustrating a construction of a pump-type ampoule container capable of being refilled according to a preferred embodiment of the present invention. FIG. 2 is a disassembled perspective view illustrating a construction of a pump-type ampoule container capable of being refilled according to a preferred embodiment of the present invention.

Figure 3:
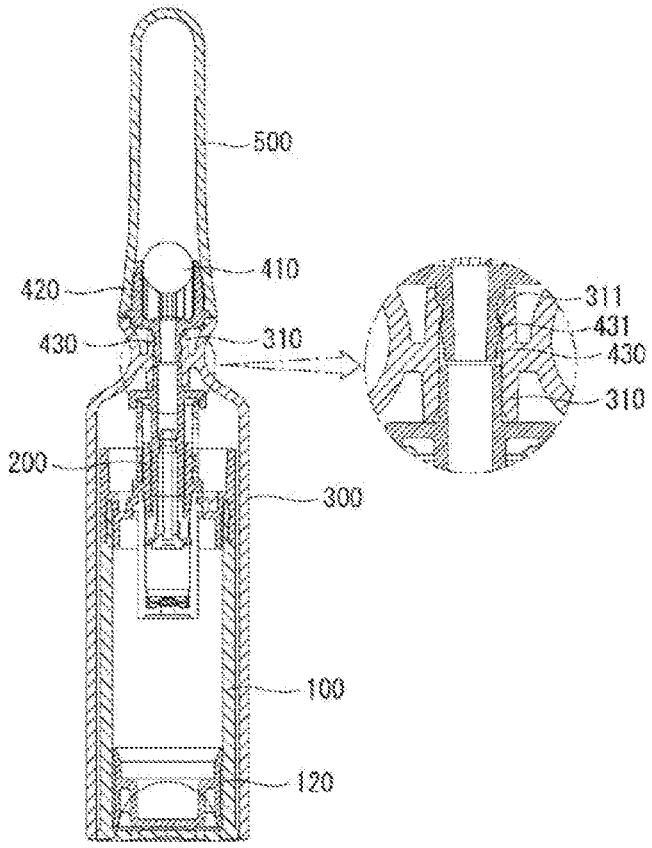
FIG. 3 is a cross sectional view illustrating a construction of a pump-type ampoule container capable of being refilled according to a preferred embodiment of the present invention.

FIG. 3 is a cross sectional view illustrating a construction of a pump-type ampoule container capable of being refilled according to a preferred embodiment of the present invention.

Figure 4A:
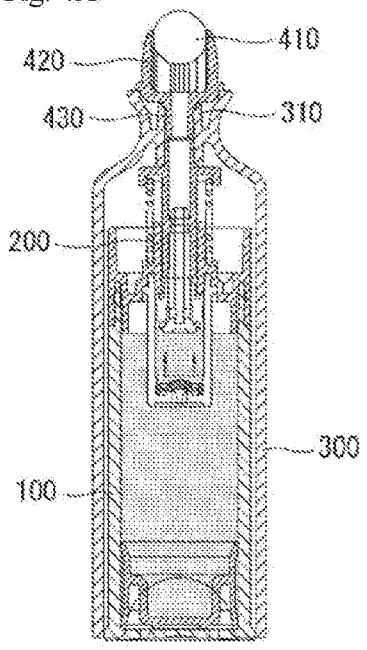
FIG. 4A and FIG. 4B are views illustrating an operation state of a pump-type ampoule container capable of being refilled according to a preferred embodiment of the present invention.
Figure 4B:
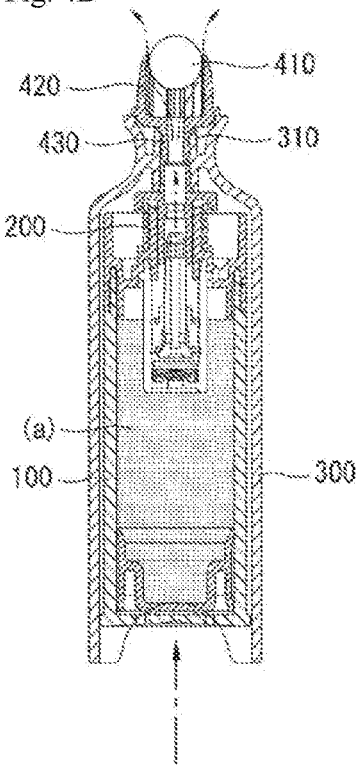

FIG. 4 is a view illustrating an operation state of a pump-type ampoule container capable of being refilled according to a preferred embodiment of the present invention.

As shown in FIGS. 1 to 4, the pump-type ampoule container capable of being refilled according to a preferred embodiment of the present invention comprises an inner container 100, a pumping member 200, an outer container 300, a discharge part 400, and an over cap 500.

The inner container 100 is constituted to contain contents, whose top is open to discharge contents. A pumping member 200 is secured to the opened top.

In the present invention, the inner container 100 is inserted in the outer container 300 and can be separated from the same, and the inner container 100 is exchanged with an inner container 100' when the contents contained in the inner container 100 is all used.

It is preferred that the inner container 100 includes a shoulder 110 covering a lower, outer circumferential surface of the inner container 100 for the inner container 100 to be easily removed for its exchange.

As shown in FIG. 4, the inner container 100 ascends or descends in the outer container 300 on the basis of a user's pressing for thereby enabling the pump member 200 to perform a pumping operation, thus discharging the contained contents to the outside.

The pumping member 200 is secured to top of the inner container 100 and discharge the contents contained in the inner container 100 on the basis of pumping operations. In the present invention, the top of the pumping member 200 is secured to a communication part 310 and is thus configured to communicate with the discharge part 400.

The pumping member 200 becomes disengaged from the communication part 310 when the inner container 100 separates from the inner container 300. When the inner container 100 is inserted in the outer container 300, the pumping member 200 is secured to the communication part 310 for thereby discharging contents via the discharge part 400.

The pumping member 200 are known to an ordinary person skilled in the art, so the detailed descriptions thereof will be omitted.

The outer container 300 accommodates the inner container 100 and the pumping member 200, a lower portion of which outer container is open for the inner container 100 and the pumping member 20 to be inserted in the outer container 300 and to be separated from. Both sides of the lower portion of the outer container 300 are cut-away for the user to easily grasp the inner container 100 when it is exchanged.

Since both sides of the lower portion of the outer container 300 are cut-away, it is easy to discharge and exchange the inner container 100. When the user presses the bottom of the inner container 100 with fingers, and the inner container 100 ascends, there will be no interference with the outer container 300, thus obtaining smooth pumping operations.

In the present invention, a communication part 310 is provided at the inner side of the top of the outer container 300 and extends from an inner circumferential surface of the outer container 300 to its center and define a space for the contents to move through the space. The top of the pumping member 200 is secured to the bottom of the communication part 310, and the bottom of the discharge part 400 is secured to top of the communication part 310 for thereby allowing the pumping member 200 and the discharge part 400 to communicate with each other, so the contents can be discharged outside via the discharge part 400 in the course of the pumping operations of the pumping member 200.

A fixing shoulder 311 is formed in an inner circumferential surface of the communication part 310 so as to prevent the discharge part 400 from being disengaged in the upward direction.

The discharge part 400 is secured to top of the outer container 300 and communicates with the pumping member 200 via the communication part 310. The contents can be discharged outside on the basis of the pumping operations of the pumping member 200 as the inner container 100 ascends or descends. The discharge part 400 comprises an applicator 410, a support part 420 and an engaging part 430.

With the applicator 410, a user applies contents on his own skin. In the present invention, a ball type applicator 410 is adapted. All kinds of applying means such as a silicon tip type, a brush type, etc. may be adapted.

The support part 420 is configured to supportably accommodate the applicator 410. In the inner portion of the support part 420 is disposed a support protrusion 421 that supports the bottom of the applicator 410.

The support part 420 is equipped with the support protrusion 421, so a space is formed between the inner side of the support part 420 and the applicator 410. A predetermined amount of contents is filled in the space between the inner side of the support part 420 and the applicator 410 in the course of the pumping operations of the pumping member 200, and the residual amount of the contents is discharged with the applicator 420, so it is possible to prevent all the contents from being discharged at a time with the applicator 410.

The engaging part 430 extends in a downward direction of the support part 420 and is engaged to the communication part 310 and comprises a fixing protrusion 431 engaged to the fixing shoulder 311 of the communication part 310 for the same to be fixedly engaged to the communication part 310.

The engaging part 430 is configured in a hollow shape through which the contents move for the contents to be discharged via the discharge part 400 in the course of the pumping operations of the pumping member 200.

In the present invention, there is further included an over cap 500 that is engaged covering the discharge part 400 from the top of the outer container 300 so as to prevent the applicator 410 from being broken by an external impact.

Figure 5A:
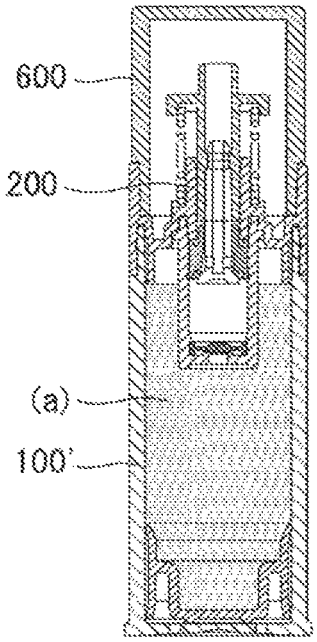
FIG. 5A, FIG. 5B, FIG. 6A, FIG. 6B and FIG. 6C are views illustrating an exchanging procedure of a pump-type ampoule container capable of being refilled according to a preferred embodiment of the present invention.
Figure 5B:
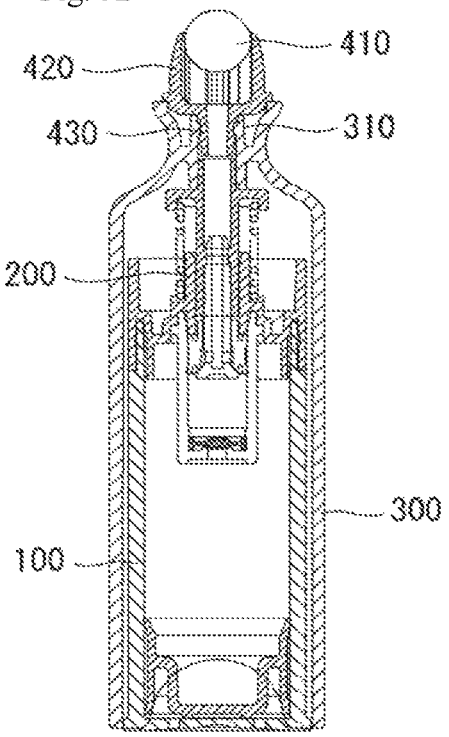
Figure 6A:
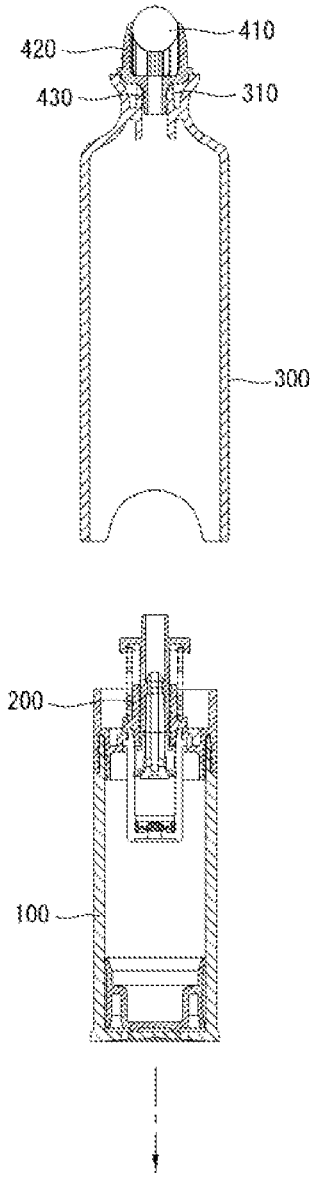
Figure 6B:
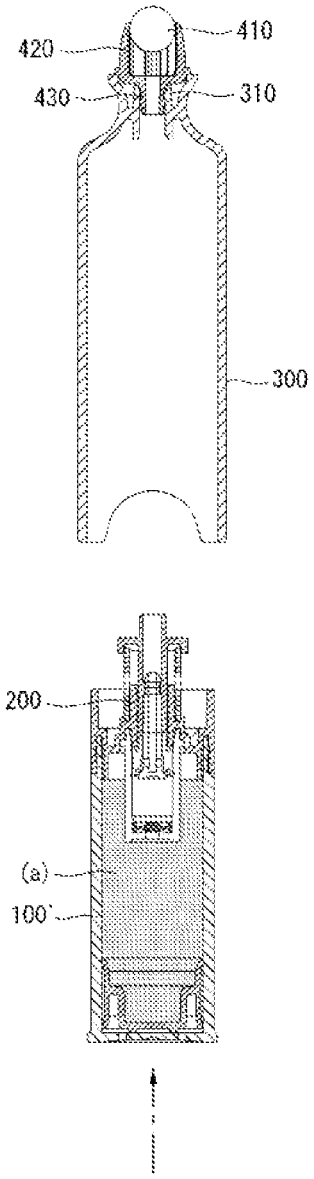
Figure 6C:
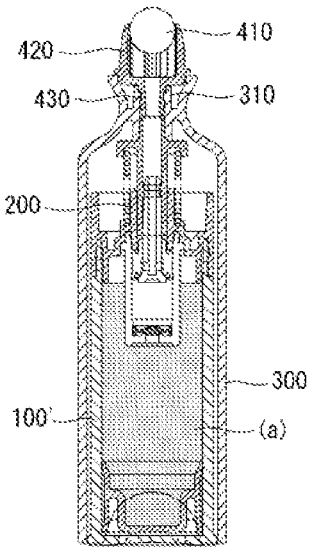

The exchanging procedure of the pump-type ampoule container capable of being refilled according to the preferred embodiments of the present invention will be described with reference to FIGS. 5 and 6. FIGS. 5 and 6 are views illustrating an exchanging procedure of a pump-type ampoule container capable of being refilled according to a preferred embodiment of the present invention.

As shown in FIGS. 5 and 6, in the exchanging procedure of the pump-type ampoule container capable of being refilled according to the preferred embodiments of the present invention, when all the contents contained in the inner tube 100 is used, the inner container 100 is disengaged via the open bottom of the outer container 300, thus separating the inner container 100 and the outer container 300. At this time, the pumping member 200 secured to top of the inner container 100 is disengaged from the outer container 300.

Next, the inner container 100' filled with contents "a" is inserted via the open bottom of the outer container 300. When the inner container 100' is inserted in the outer container 300, the pumping member 200 secured to top of the inner container 100 is together inserted. The top of the pumping member 200 is secured to the bottom of the communication part 310 of the outer container 300 and is fixed.

At this time, the inner container 100' filled with the contents "a" is provided in a set that includes the pumping member 200 secured to top of the inner container 100' and a refill cap 600 secured covering the pumping member 200. When the inner container 100' is inserted in the outer container 300, it needs to remove the refill cap 600 secured to top of the inner container 100', and it is inserted in the outer container 300.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A pump-type ampoule container capable of being refilled, comprising:

an inner container (100) that contains contents;

a pumping member (200) that is secured to top of the inner container (100) and discharges the contents contained in the inner container (100) on the basis of a pumping operation;

an outer container (300) that is configured to accommodate the inner container (100) and the pumping member (200) and includes an open bottom for the inner container and the pumping member (200) to be inserted or to be disengaged via the open bottom, wherein two lower sides of the outer container (300) are partly cut-away for a user to grasp the inner container (100) for its exchange;

a discharge part (400) that is secured to a top of the outer container (300) and is in communication with the pumping member (200) and is configured to discharge outside the contents on the basis of the pumping operation of the pumping member (200) as the inner container (100) ascends or descends; and an over cap (500) that is secured covering the discharge part (400) from the top of the outer container (300); and wherein a communication part (310) is provided in an inner side of the top of the outer container (300) and extends from an inner circumferential surface of the outer container (300) to its center portion and includes a space through which contents move, the communication part (310) allowing the pumping member (200) and the discharge part (400) to communicate; and wherein the discharge part (400) comprises:

an applicator (410) with which to apply contents on a user's skin;

a support part (420) that accommodates the applicator (410) and supports the applicator (410); and an engaging part (430) that extends in a downward direction of the support part (420) and includes a hollow shape through which move the contents and that is secured to the communication part (310), and wherein the engaging part (430) comprises a fixing protrusion (431) engaged to a fixing shoulder (311) of the communication part (310) so as to fixedly engage the engaging part (430) to the communication part (310), wherein the support part (420) comprises a multitude of support protrusions (421) that support a portion of the bottom of the applicator (410) so as to lead to formation of a space between the inside of the support part (420) and the applicator (410), wherein the support protrusions (421) have a shape of a rib-shaped plank protruding toward a center axis of the discharge part (400) along an inner side of the support part (420), wherein the pumping member (200) becomes disengaged from the communication part (310) when the inner container (100) separates from the inner container (300) for refill, and when the inner container (100) is inserted in the outer container (300), the pumping member (200) is secured to the communication part (310) for thereby discharging contents via the discharge part (400), and wherein the inner container (100) ascends in the outer container (300) on the basis of a user's pressing for thereby enabling the pump member (200) to perform the pumping operation, thus discharging the contained contents to the discharge part (400).

2. The container of claim 1, wherein the inner container (100) comprises a shoulder (110) that covers an outer circumferential surface of the bottom of the inner container (100).

* * * * *